US010337483B2

(12) United States Patent
Hannah et al.

(10) Patent No.: US 10,337,483 B2
(45) Date of Patent: Jul. 2, 2019

(54) ELECTRIC STARTER MOTOR FOR A GAS ENGINE

(71) Applicant: TTI (MACAO COMMERCIAL OFFSHORE) LIMITED, Macau (MO)

(72) Inventors: Mark E. Hannah, Anderson, SC (US); Sven Eschrich, Berglen (DE)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/410,579

(22) Filed: Jan. 19, 2017

(65) Prior Publication Data

US 2017/0204829 A1 Jul. 20, 2017

Related U.S. Application Data

(60) Provisional application No. 62/280,667, filed on Jan. 19, 2016.

(51) Int. Cl.

| | |
|---|---|
| ***F02N 15/02*** | (2006.01) |
| ***F02N 5/04*** | (2006.01) |
| ***F02N 11/08*** | (2006.01) |
| ***F02N 11/00*** | (2006.01) |
| *F02N 15/00* | (2006.01) |
| *F02N 15/04* | (2006.01) |
| *F02P 15/08* | (2006.01) |

(52) U.S. Cl.

CPC ..... *F02N 15/02* (2013.01); *F02N 5/04* (2013.01); *F02N 11/00* (2013.01); *F02N 11/0851* (2013.01); *F02N 15/006* (2013.01); *F02N 15/043* (2013.01); *F02P 15/08* (2013.01)

(58) Field of Classification Search

CPC .... F02P 1/00; F02P 1/005; F16F 15/31; F16F 15/3153; F16C 3/06; F02N 5/04; F02N 11/08; F02N 11/0851; F02N 11/0852; F02N 15/02

USPC ..... 123/149 D, 179.22, 192.1, 192.2, 618; 290/1 R

See application file for complete search history.

(56) References Cited

U.S. PATENT DOCUMENTS

| | | | | |
|---|---|---|---|---|
| 4,579,092 A * | 4/1986 | Kandler | F01L 1/04 | 123/196 CP |
| 2002/0005699 A1* | 1/2002 | Koenen | F02N 11/04 | 318/400.01 |
| 2005/0090370 A1* | 4/2005 | Berger | B60K 6/48 | 477/167 |
| 2006/0070602 A1* | 4/2006 | Georgescu | F01C 1/063 | 123/245 |

(Continued)

*Primary Examiner* — Hung Q Nguyen
*Assistant Examiner* — Johnny H Hoang
(74) *Attorney, Agent, or Firm* — Morgan, Lewis & Bockius, LLP

(57) ABSTRACT

The various implementations described herein include apparatuses and methods used to operate engine-based equipment using an electric starter motor. In one aspect, a method for operating an apparatus includes starting an electric starter motor. In response to starting the electric starter motor, the electric starter motor is coupled to a flywheel and the flywheel is turned. In response to turning the flywheel, an engine coupled to the flywheel via a power take-off of the engine is started. After starting the engine, the electric starter motor is decoupled from the flywheel and thus from the engine, and the engine is used to turn the flywheel, thereby enabling operation of a primary assembly coupled to the flywheel.

11 Claims, 2 Drawing Sheets

(56) References Cited

U.S. PATENT DOCUMENTS

2007/0227470 A1* 10/2007 Cole ..... H02K 1/2786
123/3
2007/0277644 A1* 12/2007 King ..... F16D 1/076
74/572.2
2008/0148881 A1* 6/2008 Moniz ..... F02C 7/32
74/15.6
2008/0238104 A1* 10/2008 Dale ..... F03B 17/005
290/54
2010/0122882 A1* 5/2010 Komorowski ..... F16D 27/105
192/35
2010/0264759 A1* 10/2010 Shafer ..... H02K 1/20
310/54
2010/0282187 A1* 11/2010 Gilpatrick ..... B08B 3/026
123/2
2010/0294231 A1* 11/2010 Kusel ..... F01M 1/12
123/196 R
2010/0307129 A1* 12/2010 Chen ..... F02C 3/165
60/39.35
2011/0017168 A1* 1/2011 Gilpatrick ..... F02B 63/00
123/197.5
2013/0312415 A1* 11/2013 Dubovitskiy ..... F01K 25/08
60/651
2016/0258409 A1* 9/2016 Marthaler ..... F02N 11/003

* cited by examiner

ELECTRIC STARTER MOTOR FOR A GAS ENGINE

RELATED APPLICATION

This application claims priority to U.S. Provisional Patent Application No. 62/280,667, titled "Electric Starter Motor for a Gas Engine," filed Jan. 19, 2016, which is hereby incorporated by reference in its entirety.

TECHNICAL FIELD

The disclosed embodiments relate generally to engine-based equipment, and, in particular, to operating engine-based equipment using an electric starter motor.

BACKGROUND

Various kinds of equipment use pull cords as a mechanism for starting the equipment's engine by hand. Such pull-cord mechanisms, however, are often difficult to use, and thus complicate the operation of equipment.

SUMMARY

Accordingly, there is a need for more efficient and effective methods and apparatuses for operating engine-based equipment.

In accordance with some embodiments, an apparatus includes an engine with a power take-off extending from the engine. The apparatus also includes a rotatable input shaft coupled to the power take-off, to rotate with the power take-off; a flywheel fixed to the input shaft, to rotate with the input shaft; and an electric starter motor to couple to and turn the flywheel to start the engine and to decouple from the flywheel after the engine starts. The apparatus further includes a primary assembly, the operation of which is enabled by using the engine to turn the input shaft.

In accordance with some embodiments, an apparatus includes a rotatable input shaft to couple to a power take-off extending from an engine, to rotate with the power take-off; a flywheel fixed to the input shaft, to rotate with the input shaft; an electric starter motor to couple to and turn the flywheel to start the engine and to decouple from the flywheel after the engine starts; and a primary assembly, the operation of which is enabled by using the engine to turn the input shaft.

In accordance with some embodiments, an apparatus includes: (1) an engine, which includes a power take-off; (2) a starter assembly, including: a starter motor, a battery, a gear reduction, and a drive assembly that includes a drive spring and a drive gear, wherein the starter motor and drive assembly are coupled via the gear reduction; (3) a flywheel having an outer surface to which a starter gear is attached; (4) an input shaft to which the flywheel is fixed, the input shaft being coupled to the power take-off of the engine via a keyway, wherein: the input shaft is configured to turn in response to the starter motor and the engine; the starter assembly is configured to engage the drive gear with the starter gear, to turn the flywheel to start the engine, and to disengage the drive gear from the starter gear and thus decouple the engine from the starter motor after the engine is started; and (5) a primary assembly, operation of which is enabled by using the engine to turn the input shaft. The starter assembly, flywheel, and assembly input can be used with and/or added to a conventional pull-start engine to provide electric start capability for the engine without requiring modifications to the engine.

In accordance with some embodiments, a method for operating an apparatus includes starting an electric starter motor. In response to starting the electric starter motor, the electric starter motor is coupled to a flywheel and the flywheel is turned. In response to turning the flywheel, an engine coupled to the flywheel is started. After starting the engine, the electric starter motor is decoupled from the flywheel and thus from the engine, and the engine is used to turn the flywheel, thereby enabling operation of a primary assembly coupled to the flywheel.

In this way, electric start capability is provided without significant costs associated with design or manufacturing changes for the engine.

BRIEF DESCRIPTION OF THE DRAWINGS

For a better understanding of the various described embodiments, reference should be made to the Description of Embodiments below, in conjunction with the following drawings. Like reference numerals refer to corresponding parts throughout the figures and description.

DETAILED DESCRIPTION

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, components, and circuits have not been described in detail so as not to unnecessarily obscure aspects of the embodiments.

Figure 1:
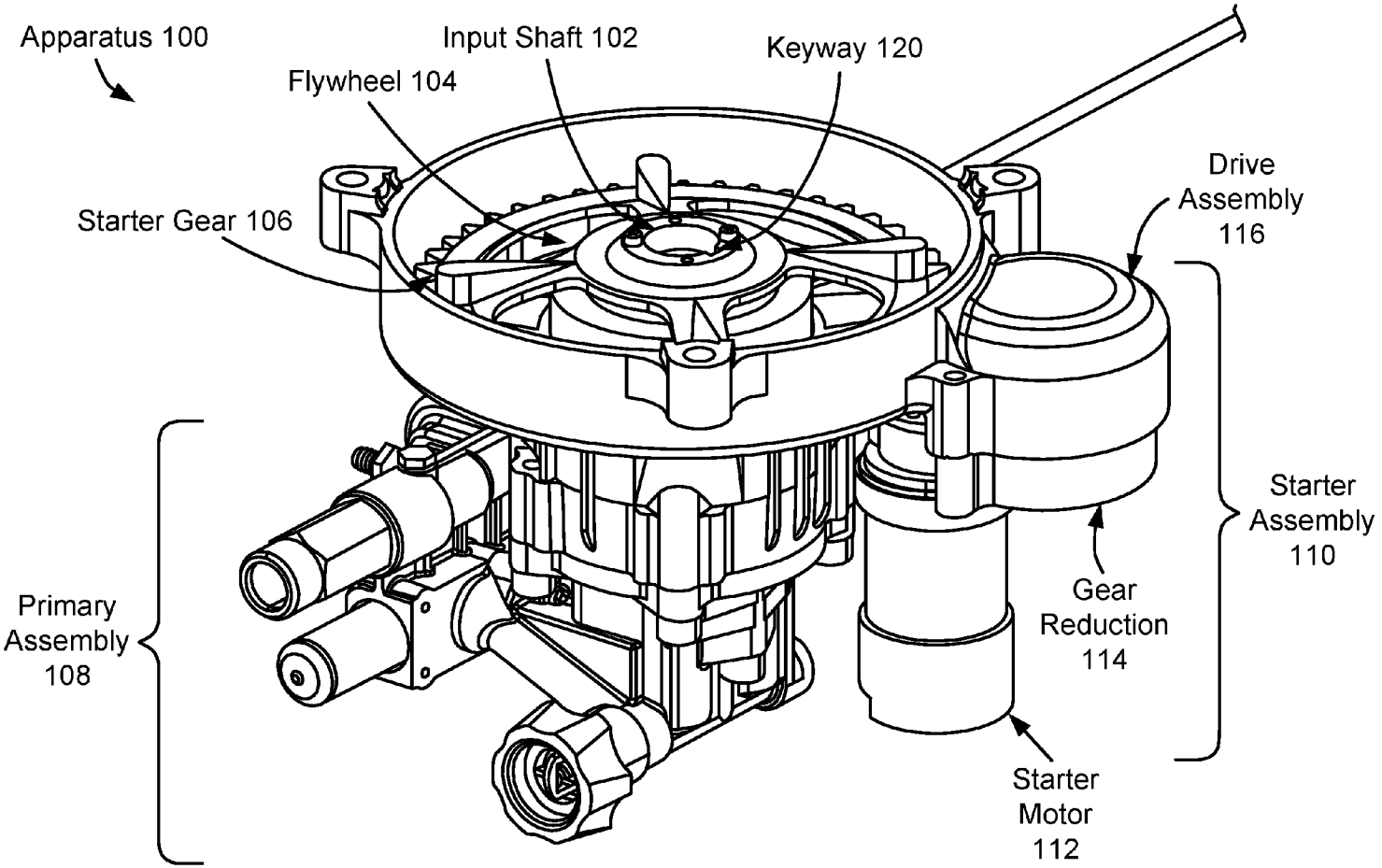
FIG. 1 is a perspective view of an apparatus that is operated by an electric starter motor, in accordance with some embodiments.

FIG. 1 illustrates a perspective view of an apparatus that is operated by an electric starter motor, in accordance with some embodiments.

The apparatus 100 may be any machinery or equipment driven by an engine, such as a pressure washer or leaf blower. As shown, in some embodiments, the apparatus 100 includes a starter assembly 110, a flywheel 104, an input shaft 102, a primary assembly 108, and an engine (atop the flywheel 104 and input shaft 102, not shown). When the starter assembly 110 is started (e.g., starter motor is 112 powered on), the drive assembly 116 engages and turns the flywheel 104 and the input shaft 102, which is rotatable. In response, a power take-off of the engine (not shown) coupled to the flywheel 104 via the input shaft 102 is also turned, thereby starting the engine. (The power take-off extends from the engine into the input shaft.) At this point, the starter assembly 110 (e.g., the drive assembly 116) disengages from the flywheel 104, and the engine (but not the starter assembly 110) continues turning the input shaft 102, thus driving and enabling operation of the primary assembly 108.

The primary assembly 108 (e.g., a high-pressure water-pump assembly or blower assembly) includes mechanical and/or electrical components driven by the engine. In some embodiments, the primary assembly 108 is coupled to the engine via a power take-off of the engine and the input shaft 102, where the primary assembly 108 is operated and driven by the turning of the input shaft 102 (e.g., by the engine's power take-off).

The flywheel 104 has an outer surface to which a starter gear 106 is attached. As shown, the input shaft 102 is fixed to the flywheel 104 such that rotational movement of the flywheel 104 turns the input shaft 102, and rotational movement of the input shaft 102 turns the flywheel 104. In some embodiments, the input shaft 102 is configured to turn in response to the starter motor 112 and the engine. As previously stated, the engine is atop the flywheel 104. As FIG. 1 shows, the primary assembly 108 is below the flywheel 104. The flywheel 104 and starter gear 106 are thus situated between the engine and the primary assembly 108.

The engine (not shown) is used to actuate mechanical components of the primary assembly 108 to enable operation of the apparatus 100 (e.g., a pressure washer apparatus, a leaf blower apparatus, etc.). In some embodiments, the engine is an internal combustion engine that uses gasoline (i.e., petrol). The engine includes a rotatable power take-off (e.g., a drive shaft) coupled to the input shaft 102. The power take-off and the input shaft 102 may be securely coupled by aligning both components via the keyway 120 (e.g., a square keyway). In some embodiments, the engine includes a pull start (e.g., a pull cord) that may be used instead of the starter assembly 110 to start the engine (e.g., by a recoil start method). For example, the engine can be a conventional pull-start engine that is also selectively coupled to the starter assembly 110 through the power take-off and the flywheel 104 to provide the additional electric start capability.

The starter assembly 110 is used to start the engine. As shown, the starter assembly 110 may include a starter motor 112, a gear reduction 114, a drive assembly 116, and a battery (e.g., a battery pack) (not shown) for powering the starter motor 112. The battery is electrically connected to the starter motor 112. In some embodiments, the starter motor 112 is a direct current (DC) powered motor. In some embodiments, the gear reduction 114 includes a plurality of coupled mechanical gears, the sizes and configuration of which define a speed ratio for manipulating an output speed of the starter motor 112 (e.g., when coupled to the starter motor 112, the gear reduction 114 outputs a slower rotational speed than the output speed of the starter motor 112).

The drive assembly 116 includes components for coupling the starter motor 112 to the flywheel 104 (and thus to the engine). In some embodiments, the drive assembly 116 is a helical Bendix-style drive assembly. In some embodiments, the drive assembly 116 includes a drive spring and a drive gear, where the drive gear may be placed on the drive spring. When the starter motor 112 begins turning, the inertia of the drive assembly 116 winds the drive spring. The length of the drive spring changes as it winds, causing the drive gear to engage with the starter gear 106 and causing the starter motor 112 to couple to the engine (via the flywheel 104, the input shaft 102, and the power take-off of the engine). Thereafter, the engine starts, which causes the drive assembly 116 to exceed the rotational speed of the starter motor 112. Consequently, the starter gear 106 disengages from the drive gear of the drive assembly 116, and thus the engine decouples from the starter motor 112.

Figure 2:
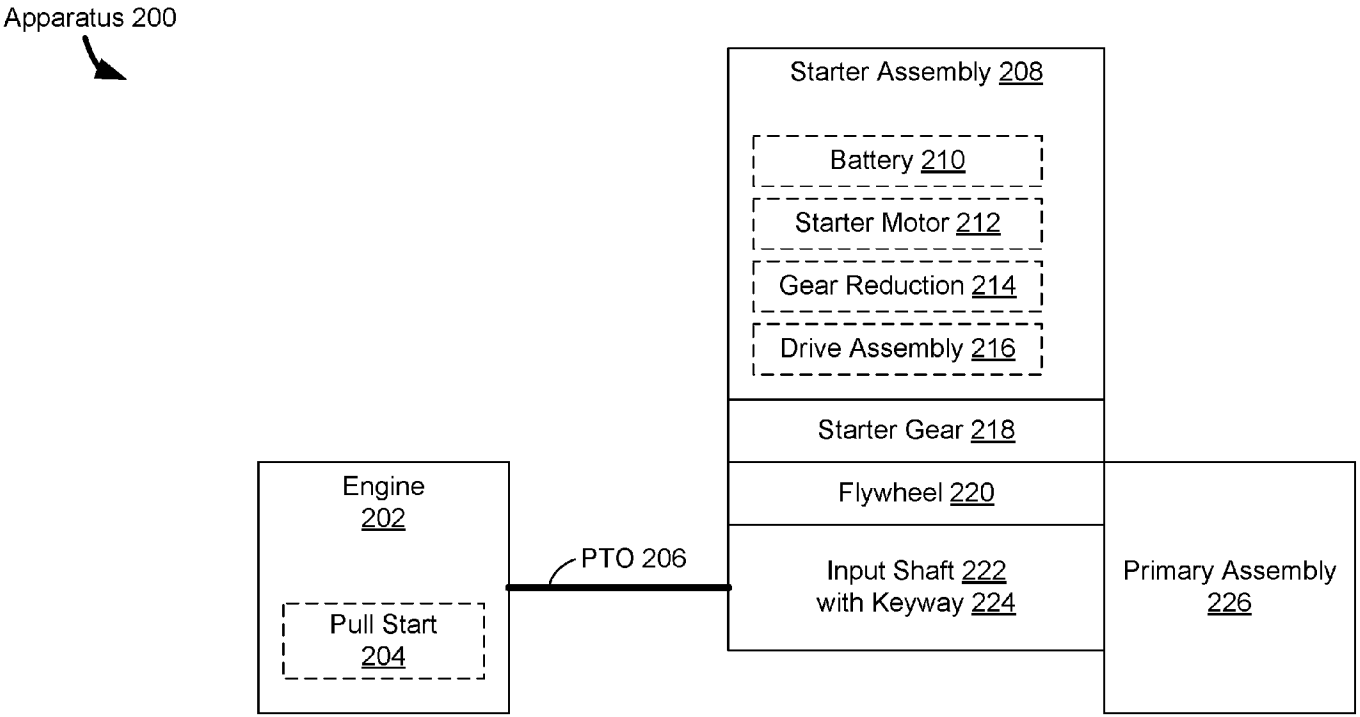
FIG. 2 is a block diagram of an apparatus with an engine and an electric starter motor, in accordance with some embodiments.

FIG. 2 is a block diagram of an apparatus 200 with an engine 202 and an electric starter motor 212, in accordance with some embodiments. (As a block diagram, FIG. 2 is not intended to show the actual physical arrangement of the listed components.) The apparatus 100 (FIG. 1) is an example of the apparatus 200. The apparatus 200 includes the engine 202, a power take-off (PTO) of the engine 206, a starter assembly 208 (e.g., starter assembly 110, FIG. 1), a starter gear 218 (e.g., starter gear 106, FIG. 1), a flywheel 220 (e.g., flywheel 104, FIG. 1), an input shaft 222 with a keyway 224 (e.g., input shaft 102 with keyway 120, FIG. 1), and a primary assembly 226 (e.g., primary assembly 108, FIG. 1). In some embodiments, the engine 202 includes a pull start 204 (i.e., a pull-cord starter for starting the engine 202). In some embodiments, the starter assembly includes a battery 210, the electric starter motor 212 (e.g., starter motor 112, FIG. 1), a gear reduction 214 (e.g., gear reduction 114, FIG. 1), and a drive assembly 216 (e.g., drive assembly 116, FIG. 1). The drive assembly 216 may include a drive spring and drive gear.

In some embodiments, a method of operating the apparatus 200 (FIG. 2) (e.g., the apparatus 100, FIG. 1) includes starting the electric starter motor 212 (e.g., powering on the starter motor 112 by flipping a switch, pressing a button, etc.). In response to starting the electric starter motor 212, the electric starter motor 212 couples to the flywheel 220 (e.g., activating the starter motor 112 causes a drive gear of the drive assembly 116 to engage with the starter gear 106), and the flywheel 220 is turned (e.g., by the starter motor 112, which is coupled to the flywheel 104 via the gear reduction 114 and drive assembly 116). In response to turning the flywheel 220, the engine 202 coupled to the flywheel 220 is started (e.g., turning the flywheel 104 also turns the input shaft 102 and a coupled power take-off 206 of the engine 202). After starting the engine 202, the electric starter motor 212 is decoupled from the flywheel 220 and thus from the engine 202 (e.g., as a result of the drive assembly 116 exceeding the rotational speed of the starter motor 112), and the engine 202 is used to turn the flywheel 220, thereby enabling operation of the primary assembly 226 coupled to the flywheel 220 (e.g., via the input shaft 102 and the power take-off 206 of the engine 202).

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. An engine-driven apparatus, comprising:

an engine and a power take-off extending from the engine;

a rotatable input shaft coupled to the power take-off, to rotate with the power take-off;

a flywheel fixed to the rotatable input shaft, to rotate with the rotatable input shaft;

a starter gear fixed to an outer surface of the flywheel;

an electric starter motor to couple to and turn the flywheel to start the engine and to decouple from the flywheel after the engine starts;

a primary assembly, operation of which is enabled by using the engine to turn the rotatable input shaft; and a drive assembly coupled to the starter motor and including:

a drive gear to couple to the flywheel in response to the starter motor starting and to decouple from the flywheel in response to the engine starting, and a drive spring to cause the drive gear to engage with the starter gear in response to the starter motor starting.

2. The apparatus of claim 1, wherein:

the rotatable input shaft comprises a keyway; and the input shaft is coupled to the power take-off via the keyway.

3. The apparatus of claim 2, wherein the keyway is square.

4. The apparatus of claim 1, further comprising a gear reduction coupling the starter motor to the drive assembly.

5. The apparatus of claim 1, wherein the drive assembly is configured to engage the drive gear with the starter gear in response to the starter motor starting and to disengage the drive gear from the starter gear in response to the engine starting.

6. The apparatus of claim 1, wherein the drive assembly comprises a helical Bendix-style drive assembly.

7. The apparatus of claim 1, further comprising a battery, coupled to the electric starter motor, to power the electric starter motor.

8. An engine-driven apparatus, comprising:

a rotatable input shaft to couple to a power take-off extending from an engine, to rotate with the power take-off;

a flywheel fixed to the input shaft, to rotate with the rotatable input shaft;

a starter gear fixed to an outer surface of the flywheel;

an electric starter motor to couple to and turn the flywheel to start the engine and to decouple from the flywheel after the engine starts;

a primary assembly, operation of which is enabled by using the engine to turn the rotatable input shaft; and a drive assembly coupled to the starter motor and including:

a drive gear to couple to the flywheel in response to the starter motor starting and to decouple from the flywheel in response to the engine starting, and a drive spring to cause the drive gear to engage with the starter gear in response to the starter motor starting.

9. A method of starting an engine, comprising:

starting an electric starter motor;

in response to starting the electric starter motor, coupling the electric starter motor to a flywheel and turning the flywheel, wherein a starter gear is fixed to an outer surface of the flywheel;

in response to turning the flywheel, starting the engine coupled to the flywheel via a power take-off of the engine, wherein the power take-off rotates with the flywheel; and after starting the engine:

decoupling the electric starter motor from the flywheel; and using the engine to turn the flywheel, to enable operation of a primary assembly coupled to the flywheel, wherein a drive assembly coupled to the starter motor includes:

a drive gear to couple to the flywheel in response to the starter motor starting and to decouple from the flywheel in response to the engine starting, and a drive spring to cause the drive gear to engage with the starter gear in response to the starter motor starting.

10. The apparatus of claim 4, wherein the gear reduction includes a plurality of coupled mechanical gears such that the gear reduction outputs a slower rotational speed than the output speed of the rotational motor when the gear reduction is coupled to the electric starter motor.

11. The apparatus of claim 5, wherein the flywheel and the starter gear are situated between the engine and the primary assembly.

* * * * *